US008305369B2

(12) United States Patent
Okada et al.

(10) Patent No.: US 8,305,369 B2
(45) Date of Patent: Nov. 6, 2012

(54) DISPLAY DRIVE CIRCUIT, DISPLAY DEVICE, AND DISPLAY DRIVING METHOD

(75) Inventors: Atsushi Okada, Osaka (JP); Yasushi Sasaki, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 324 days.

(21) Appl. No.: 12/452,512

(22) PCT Filed: Jul. 14, 2008

(86) PCT No.: PCT/JP2008/062715

§ 371 (c)(1),
(2), (4) Date: Jan. 6, 2010

(87) PCT Pub. No.: WO2009/050926

PCT Pub. Date: Apr. 23, 2009

(65) Prior Publication Data

US 2010/0128009 A1 May 27, 2010

(30) Foreign Application Priority Data

Oct. 16, 2007 (JP) ..... 2007-269332

(51) Int. Cl.
*G09G 5/00* (2006.01)
*G09G 3/36* (2006.01)

(52) U.S. Cl. ..... 345/205; 345/100

(58) Field of Classification Search ..... 345/205, 345/87–204, 690

See application file for complete search history.

(56) References Cited

U.S. PATENT DOCUMENTS 6,084,562 A * 7/2000 Onda ..... 345/94
7,355,575 B1 4/2008 Ota et al.
2002/0084970 A1 7/2002 Ozawa
(Continued)

FOREIGN PATENT DOCUMENTS

JP 4 145490 5/1992
(Continued)

OTHER PUBLICATIONS

International Search Report, Jul. 14, 2009.
(Continued)

*Primary Examiner* — Stephen Sherman
(74) *Attorney, Agent, or Firm* — Harness, Dickey & Pierce

(57) ABSTRACT

One embodiment of the present invention includes: a gate line drive circuit that outputs, in a horizontal scanning period which is sequentially allocated to each one of rows, a gate signal for turning on the switching element on one row; a source bus line drive circuit that outputs a source signal of which polarity is reversed in sync with the horizontal scanning period for each of the rows and of which polarity is opposite in an adjacent horizontal scanning period on one and the same row; a CS bus line drive circuit that outputs, after the horizontal scanning period for each of the rows, a CS signal of which potential is switched along a direction (from low level to high level or from high level to low level) determined according to the polarity of the source signal in the horizontal scanning period concerned, wherein the CS bus line drive circuit outputs the CS signal in a first frame so that a potential of the CS signal at a time of on-to-off switching of the switching element on the one row is different from a potential of a CS signal on an adjacent row. This eliminates the occurrence of lateral stripes in the first frame from which display corresponding to a video signal is started in CC driving premised on line inversion driving.

9 Claims, 10 Drawing Sheets

U.S. PATENT DOCUMENTS

| | | | | |
|---|---|---|---|---|
| 2003/0179172 | A1 | 9/2003 | Miyachi | |
| 2005/0036078 | A1 | 2/2005 | Tsunashima | |
| 2005/0122441 | A1* | 6/2005 | Shimoshikiryoh | 349/38 |
| 2006/0181498 | A1 | 8/2006 | Toyozawa et al. | |
| 2007/0075956 | A1 | 4/2007 | Satou et al. | |
| 2007/0188431 | A1 | 8/2007 | Sato et al. | |

FOREIGN PATENT DOCUMENTS

| | | |
|---|---|---|
| JP | 4145490 | 5/1992 |
| JP | 6-265846 | 9/1994 |
| JP | 2001-083943 | 3/2001 |
| JP | 200183943 | 3/2001 |
| JP | 2003-279929 | 10/2003 |
| JP | 2004-226785 | 8/2004 |
| JP | 2005-049849 | 2/2005 |
| JP | 2007-047703 | 2/2007 |
| JP | 2009-116122 | 5/2009 |
| WO | WO 2005/045795 | 5/2005 |
| WO | WO 2009/050926 | 4/2009 |

OTHER PUBLICATIONS

International Search Report dated Jul. 14, 2009 for PCT/JP2009/061303.

M. Rafiquzzaman, "Sequential Logic Design," *Fundamentals of Digital Logic and Microcomputer Design*, John Wiley & Sons, Inc., 2005.

* cited by examiner

DISPLAY DRIVE CIRCUIT, DISPLAY DEVICE, AND DISPLAY DRIVING METHOD

TECHNICAL FIELD

The present invention relates to a display drive circuit and display driving method for driving a display panel, for example, like an active matrix liquid crystal display panel, including a plurality of rows each including a scan signal line, a switching element that is turned on/off by the scan signal line, the pixel electrode connected to one end of the switching element, and a capacitive coupling interconnection capacitively-coupled to the pixel electrode, and further including a data signal line connected to the other end of the switching element on each of the rows.

BACKGROUND ART

Conventionally, a driving scheme referred to as "CC (Charge Coupling) driving" has been adopted for an active matrix-type liquid crystal display device. The CC driving is disclosed in Patent Literature 1, for example. Taking disclosure of Patent Literature 1 as an example, the CC driving will be described as below.

The structure of a device realizing the CC driving is shown in an equivalent circuit of FIG. 8, and operating waveforms of various kinds of signals in the CC driving are shown in a timing chart of FIG. 9.

As shown in the equivalent circuit of FIG. 8, a liquid crystal display device that performs the CC driving is provided, inside an image display section 110, with: a plurality of source lines (signal lines) 101; a plurality of gate lines (scan lines) 102 that intersect with these source lines 101; switching elements 103 provided in the vicinity of the intersections; pixel electrodes 104 connected to the switching elements 103; a plurality of CS (Capacity Storage) bus lines (common electrode lines) 105 each pairing up with each of the gate lines 102 and disposed in parallel to the gate lines 102; retention capacitors 106 each one end of which is connected to each of the pixel electrodes 104 and each other end of which is connected to each of the CS bus lines 105; and counter electrodes 109 opposed via liquid crystal 107.

The switching element 103 is formed with amorphous silicon (a-Si), polycrystal polysilicon (p-Si), single crystal silicon (c-Si), or the like, and a gate-drain capacity 108 is formed, considering the structure of the switching element 103. The capacity 108 causes the phenomenon in which a gate pulse from the gate line 102 shifts a potential of the pixel electrode 104 to a negative side.

Further, such a liquid crystal display device is provided, outside the image display section 110, with a source line drive circuit 111 that drives the source lines 101, a gate line drive circuit 112 that drives the gate lines 102, and a CS bus lien drive circuit 113 that drives the CS bus lines 105.

Operating waveforms of various kinds of signals in the liquid crystal display device are as shown in FIG. 9. That is, a waveform Wg of a certain gate line 102 goes Von only in a H period (horizontal scanning period) in which the gate line 102 is selected, and holds Voff in the other periods. A waveform Ws of the source line 101 becomes a waveform such that a polarity is reversed every H period and the polarity is opposite in an adjacent H period on the same gate line 102 (line inversion driving), although amplitude of the waveform Ws varies depending upon a video image to be displayed. Note that since the case of FIG. 9 assumes that a uniform video image signal is inputted, amplitude of the waveform Ws is constant in FIG. 9.

In a Von period of Wg, the waveform Wd of the pixel electrode 104 is of the same potential as the waveform Ws of the source line 101 since the switching element 103 is brought into conduction. At the moment in time when Wg goes Voff, the waveform Wd of the pixel electrode 104 slightly shifts to a negative side via the gate-drain capacitor 108.

A waveform Wc of the CS bus line 105 goes Ve+ in a H period in which the corresponding gate line 102 is selected and in the subsequent H period. In a further subsequent H period, the waveform Wc is switched to Ve− and then holds Ve− until the next field. This switching allows the waveform Wd of the pixel electrode 104 to shift to a negative side via the retention capacitor 106.

As a result, the waveform Wd of the pixel electrode 104 obtains amplitude greater than that of the waveform Ws of the source line 101. This makes it possible to make the amplitude of the waveform Ws of the source line 101 smaller. This realizes a simplified circuit configuration of the source line drive circuit 111 and reduction of power consumption.

Citation List

Patent Literature 1

Japanese Patent Application Publication, Tokukai, No. 2001-83943 A (Publication Date: Mar. 30, 2001)

SUMMARY OF INVENTION

The inventors of the present invention found that a liquid crystal display device adopting the CC driving premised on the above-described line inversion driving causes display problem at the start of display. The problem the inventors observed was alternating light and dark lateral stripes along the respective rows (each row corresponds to 1 horizontal line of a display device) in a first frame after the start of display. In view of this, the inventors of the present invention studied the cause of the above-described problem.

As a result of the study, the inventors of the present invention sought that the problem was caused by partial difference in operating waveforms of various kinds of signals between at the start of display and at the normal display. The cause will be described with reference to a timing chart of FIG. 10.

In FIG. 10, Vsync is a vertical sync signal that defines a timing of vertical scanning, Hsync is a horizontal sync signal that defines a timing of horizontal scanning. A period between a fall and a subsequent fall of Vsync is 1 vertical scanning period (1V period), and a period between a fall and a subsequent fall of Hsync is 1 horizontal scanning period (1H period). POL is a polarity signal of which polarity is reversed in sync with the horizontal scanning period.

Further, FIG. 10 illustrates the followings in this order: a source signal S that is supplied from a source line drive circuit to a certain source line (source line provided on an x-th column); a gate signal G1 that is supplied from a gate line drive circuit to a gate line provided on a first row; a CS signal CS1 that is supplied from a CS bus line drive circuit to a CS bus line on a first row; and a potential waveform Pix1 of a pixel electrode provided on the first row and on the x-th column. Still further, FIG. 10 illustrate the followings in this order: a gate signal G2 that is supplied to the gate line provided on the second row; a CS signal CS2 that is supplied to the CS bus line provided on the second row; and a potential waveform Pix2 of the pixel electrode provided on the second row and on the x-th column. Yet further, FIG. 10 illustrates the followings in this order: a gate signal G3 that is supplied to the gate line provided on the third row; a CS signal CS3 that is supplied to the CS bus line provided on the third row; and a potential waveform Pix3 of the pixel electrode provided on the third row and on the x-th column. Note that dashed lines in the potential waveforms Pix1, Pix2, and Pix3 represent potentials of the counter electrode.

In the timing chart of FIG. 10, a first frame, which follows after a liquid crystal display device starts operating upon its activation or the like, is a start frame of a display corresponding to a video image to be displayed (hereinafter such display is referred to as "video image display"), and a period before the first frame is a period in an initial state where video image display is not carried out, i.e. in a preparatory stage or in a stop state where the source line drive circuit, the gate line drive circuit, and the CS bus line drive circuit are all on standby for normal operations. Therefore, potentials of the gate signals G1, G2, and G3 are fixed to a gate-off potential (potential for turning off a gate of the switching element), and potentials of CS signals CS1, CS2, and CS3 are fixed to one potential (e.g. Vss).

In the first frame after the initial state, the source line drive circuit, the gate line drive circuit, and the CS bus line drive circuit all perform normal operations.

This allows the source signal S to be a signal that has amplitude corresponding to a tone level represented by a video signal and reverses its polarity every 1H period. Note that since the case of FIG. 10 assumes that a uniform video image is displayed, amplitude of the source signal S is constant in FIG. 10. Further, the gate signals G1, G2, and G3 are at gate-on potentials (potentials for turning on the gate of the switching element) respectively in the first, second, and third 1H periods of an active period (effective scanning period) of each frame, and the gate signals G1, G2, and G3 are at gate-off potentials in the other periods.

The CS signals CS1, CS2, and CS3 reverse after the fall of the corresponding gate signals G1, G2, and G3, respectively, and take waveforms such that their reversal directions are opposite to each other. That is, in an odd-numbered frame, the CS signals CS1 and CS3 rise after the fall of the corresponding gate signals G1 and G3, and the CS signal CS2 falls after the fall of the corresponding gate signal G2. In an even-numbered frame, the CS signals CS1 and CS3 fall after the fall of the corresponding gate signals G1 and G3, and the CS signal CS2 rises after the fall of the corresponding gate signal G2 (In the above descriptions, the odd-numbered frame and the even-numbered frame are used interchangeable). The timing of the CS signal reversals only needs to be after the fall of the gate signal, i.e. after the corresponding horizontal scanning period or may be the moment in time at which the horizontal scanning period ends (the CS signals may reverse in sync with the fall of the gate signal).

However, the potentials of the CS signals CS1, CS2, and CS3, which are all fixed to one potential in the initial state, take irregular waveforms in the first frame. That is, the first frame is the same as the other odd-numbered frame in that the CS signals CS1 and CS3 rise after the fall of the corresponding gate signals G1 and G3, but the first frame is different from the other odd-numbered frame in that the CS signal CS2 holds a constant potential after the fall of the corresponding gate signal G2.

The irregular waveforms are the cause of display problem at the start of display. That is, since in the first frame potential level changes of the CS signals CS1 and CS3 normally occur in the pixel electrodes on the first and third rows, the potential waveforms Pix1 and Pix3 are subject to potential shifts caused by the potential level changes of the CS signals CS1 and CS3. On the other hand, since the potential level change of the CS signal CS2 does not occur in the pixel electrode on the second row, the potential waveform Pix2 is not subject to potential shift (diagonally shaded areas in FIG. 10). This results in difference between the potential waveforms Pix1 and Pix3 and the potential waveform Pix2 although the source signal S of one and the same tone level is inputted thereto. This causes difference in luminance between the first and third rows and the second row. Such a difference in luminance shows up in difference in luminance between the odd-numbered rows and the even-numbered rows in the entire image display section. Consequently, alternating light and dark lateral stripes along the respective rows are observed in a video image in the first frame.

The present invention has been attained in view of the above problem, and an object thereof is to provide a display drive circuit and a display driving method both of which eliminate the occurrence of the above-described lateral stripes for improvement of display quality.

A display drive circuit of the present invention is a display drive circuit for carrying out display with a tone corresponding to a potential of a pixel electrode by driving a display panel including a plurality of rows each including a scan signal line, a switching element that is turned on/off by the scan signal line, the pixel electrode connected to one end of the switching element, and a capacitive coupling interconnection capacitively-coupled to the pixel electrode, and further including a data signal line connected to the other end of the switching element on each of the rows, and in order to solve the above problem the display drive circuit is characterized by including: a scan signal line drive circuit that outputs, in a horizontal scanning period which is sequentially allocated to the each of the rows, a scan signal for turning on the switching element on one row; a data signal line drive circuit that outputs a data signal of which polarity is reversed in sync with the horizontal scanning period for the each of the rows and of which polarity is opposite in an adjacent horizontal scanning period on one and the same row; a capacitive coupling interconnection drive circuit that outputs, after the horizontal scanning period for the each of the rows, a potential shift signal of which potential is switched between two potential levels along a direction determined according to the polarity of the data signal in the horizontal scanning period concerned, wherein the capacitive coupling interconnection drive circuit outputs the potential shift signal, in a first vertical scanning period from which output of a data signal corresponding to a video image to be displayed is started, so that a potential of the potential shift signal at a time of on-to-off switching of the switching element on the one row is different from a potential of a potential shift signal on an adjacent row.

A display panel driven by the display drive circuit has the above-described components. A typical layout thereof is such that many pixel electrodes are arranged in a matrix manner, the scan signal line, the switching element, and the capacitive coupling interconnection are disposed along each of the rows, and the data signal line is disposed along each of the columns. Note that the terms "row" and "horizontal" and the terms "column" and "vertical" indicate, in many cases, a lateral direction and a longitudinal direction of a display panel, respectively. However, this is not the only possibility in this typical layout. Alternatively, the lateral direction and the longitudinal direction may be interchanged. Therefore, the terms "row", "column", "horizontal", and "vertical" in the present invention are not intended to limit directions.

In the above-described display drive circuit that drives the display panel, the scan signal, in a horizontal scanning period which is sequentially allocated to each of the rows, turns on the switching element on one row, and a potential corresponding to a data signal of which polarity is reversed in sync with the horizontal scanning period for the each of the rows and of which polarity is opposite in an adjacent horizontal scanning period on the same row, is written to the pixel electrode connected to the switching element that has been turned on. This realizes the so-called line inversion driving.

Further, in the above display drive circuit, the potential shift signal shifts the potential of the pixel electrode capacitively coupled to the capacitive coupling interconnection. The potential shift signal is a signal of which potential is switched between two potential levels after the horizontal scanning period for each of the rows. A direction of the switching (low level to high level or high level to low level) is a direction determined according to the polarity of the data signal in the horizontal scanning period for the each of the rows. This realizes the so-called CC driving.

In the case of such a CC driving premised on the line inversion driving, that are alternating light and dark lateral stripes along the respective rows (lines) are normally observed in the first vertical scanning period (first frame) from which the output of the data signal corresponding to the video image to be displayed is started, as described above. As specifically described above, this is because the potential shift signals (CS signals CS1 and CS2) take irregular waveforms in the first vertical scanning period differently from the waveforms in the subsequent and normal vertical scanning period.

In view of this, in the above-described display drive circuit, the capacitive coupling interconnection drive circuit outputs the potential shift signal so that a potential of the potential shift signal at a time of on-to-off switching of the switching element on the one row is different from a potential of a potential shift signal on an adjacent row. This eliminates the above-described irregular waveforms that cause lateral stripes in the first vertical scanning period, and yields the effect of preventing the occurrence of the lateral stripes in the first vertical scanning period for improvement of display quality.

According to a display drive circuit of the present invention, it is preferable that, in the above display drive circuit, the capacitive coupling interconnection drive circuit outputs the potential shift signal so that the potential of the potential shift signal on the one row is different between when the switching element on the one row is turned on and when the switching element on a row subsequent to the one row is turned on.

According to the above arrangement, the potential shift signal is a signal such that the potential of the potential shift signal on the one row is different between when the switching element on the one row is turned on and when the switching element on a row subsequent to the one row is turned on. Thus, the potential of the potential shift signal at the time of on-to-off switching of the switching element on the one row is different between the adjacent rows.

This makes it possible to eliminate the above-described irregular waveforms that causes lateral stripes in the first vertical scanning period.

According to a display drive circuit of the present invention, it is preferable that in the above display drive circuit, the capacitive coupling interconnection drive circuit includes: a first input section that receives a scan signal on the one row and a scan signal on a row subsequent to the one row; a second input section that receives a polarity signal of which polarity is reversed in sync with the horizontal scanning period for the each of the rows, the polarity signal corresponding to the potential of the potential shift signal; and an output section that outputs the potential shift signal on the one row, and a first polarity of the polarity signal inputted to the second input section when the scan signal on the one row is inputted to the first input section is outputted as a first potential of the potential shift signal, while a second polarity of the polarity signal inputted to the second input section when the scan signal on the row subsequent to the one row is inputted to the first input section is outputted as a second potential of the potential shift signal.

The capacitive coupling interconnection drive circuit may comprise D-latch circuits.

This makes it possible to yield the effect of preventing the occurrence of the lateral stripes in the first vertical scanning period for improvement of display quality, with a simple circuit configuration.

According to a display drive circuit of the present invention, it is preferable that in the above display drive circuit, the capacitive coupling interconnection drive circuit outputs the potential shift signal so that a potential of the potential shift signal in an initial state is different between adjacent rows.

Here, the initial state is a state at the time when the liquid crystal display device start operating upon its activation or the like. In the initial state, the capacitive coupling interconnection drive circuit is in a preparatory stage or in a stop state where the circuit is on standby for normal operation.

According to the above arrangement, the potential levels of the potential shift signals in the initial state have been already different between the adjacent rows, which makes it possible to properly start the operation of the capacitive coupling interconnection drive circuit from the first vertical scanning period. Thus, it is possible to eliminate the above-described irregular waveforms that causes lateral stripes in the first vertical scanning period.

According to a display drive circuit of the present invention, it is preferable that the above display drive circuit further includes a control circuit that controls the signal line drive circuits and the capacitive coupling interconnection drive circuit, and the control circuit inputs to the capacitive coupling interconnection drive circuit a control signal which is different between the adjacent rows, the control signal corresponding to a polarity signal of which polarity is reversed in sync with the horizontal scanning period for the each of the rows, so that the potential of the potential shift signal in the initial state is different between the adjacent rows.

According to the above arrangement, the potential levels of the potential shift signals in the initial state can be made different between the adjacent rows, which makes it possible to eliminate the above-described irregular waveforms that causes lateral stripes in the first vertical scanning period.

According to a display drive circuit of the present invention, it is preferable that in the above display drive circuit, the control circuit outputs a first control signal if the polarity signal is of the first polarity when the scan signal on the one row is turned on in the first vertical scanning period, while the control circuit outputs a second control signal if the polarity signal is of the second polarity when the scan signal on the one row is turned on in the first vertical scanning period.

According to the above arrangement, the control signal to be outputted varies depending upon the polarity of the polarity signal. Here, the polarity signal when the scan signal is turned on in the first vertical scanning period is different between the adjacent rows. Therefore, different control signals are inputted respectively to the adjacent rows. This makes it possible to make the potential level of the potential shift signal in the initial state different between the adjacent rows.

According to a display drive circuit of the present invention, it is preferable that in the above display drive circuit, the capacitive coupling interconnection drive circuit comprises D-latch circuits, and the control circuit inputs to the capacitive coupling interconnection drive circuit a reset signal as the first control signal if the polarity of the polarity signal when the scan signal on the one row is turned on in the first vertical scanning period is in low level, while the control circuit inputs to the capacitive coupling interconnection drive circuit a set signal as the second control signal if the polarity of the polarity signal when the scan signal on the one row is turned on in the first vertical scanning period is in high level.

This makes it possible to make the potential levels of the potential shift signals in the initial state different between the adjacent rows, with a simple circuit configuration.

According to a display drive circuit of the present invention, it is preferable that in the above display drive circuit, the capacitive coupling interconnection drive circuit includes: a first input section that receives a scan signal on a row subsequent to the one row; a second input section that receives a polarity signal of which polarity is reversed in sync with the horizontal scanning period for the each of the rows, the polarity signal corresponding to the potential level of the potential shift signal; and an output section that outputs the potential shift signal on the one row, and the capacitive coupling interconnection drive circuit changes the potential of the potential shift signal in accordance with a polarity of the polarity signal inputted to the second input section when the scan signal on the row subsequent to the one row is inputted to the first input section.

According to the above arrangement, the potential of the potential shift signal is changed in accordance with a polarity of the polarity signal inputted to the second input section when the scan signal on the row subsequent to the one row is inputted to the first input section. That is, in changing the potential of the potential shift signal, it is not necessary to consider the scan signal on the one row. Therefore, it is possible to realize a simple circuit configuration.

A display device of the present invention is characterized by including any one of the above display drive circuits and the display panel.

With the above arrangement, it is possible to provide a display device with excellent display quality due to the effect of the display drive circuit preventing the occurrence of lateral stripes.

A display driving method of the present invention is a display driving method for carrying out display with a tone corresponding to a potential of a pixel electrode by driving a display panel including a plurality of rows each including a scan signal line, a switching element that is turned on/off by the scan signal line, the pixel electrode connected to one end of the switching element, and a capacitive coupling interconnection capacitively-coupled to the pixel electrode, and further including a data signal line connected to the other end of the switching element on each of the rows, and in order to solve the above problem the display driving method includes: a scan signal line driving process of outputting, in a horizontal scanning period which is sequentially allocated to the each of the rows, a scan signal for turning on the switching element on one row; a data signal line driving process of outputting a data signal of which polarity is reversed in sync with the horizontal scanning period for the each of the rows and of which polarity is opposite in an adjacent horizontal scanning period on one and the same row; and a capacitive coupling interconnection driving process of outputting, after the horizontal scanning period for the each of the rows, a potential shift signal of which potential is switched between two potential levels along a direction determined according to the polarity of the data signal in the horizontal scanning period concerned, wherein the capacitive coupling interconnection drive circuit outputs the potential shift signal, in a first vertical scanning period from which output of a data signal corresponding to a video image to be displayed is started, so that a potential of the potential shift signal at a time of on-to-off switching of the switching element on the one row is different from a potential of a potential shift signal on an adjacent row.

The above method can yield the effect of preventing the occurrence of lateral stripes in the first vertical scanning period for improvement of display quality, which is the same effect as described concerning the above display drive circuit.

A display device of the present invention is preferably a liquid crystal display device.

Additional objects, features, and strengths of the present invention will be made clear by the description below. Further, the advantages of the present invention will be evident from the following explanation in reference to the drawings.

REFERENCE SIGNS LIST

1 liquid crystal display device (display device)
10 liquid crystal display panel (display panel)
11 source bus line (data signal line)
12 gate line (scan signal line)
13 TFT (switching element)
14 pixel electrode
15 CS bus line (capacitive coupling interconnection)
20 source bus line drive circuit (data signal line drive circuit)
30 gate line drive circuit (scan signal line drive circuit)
40 CS bus line drive circuit (capacitive coupling interconnection drive circuit)
41*a*, 42*a*, 43*a*, 4*na* D-latch circuit (capacitive coupling interconnection drive circuit)
50 control circuit (control circuit)

DESCRIPTION OF EMBODIMENTS

The following will describe one embodiment of the present invention with reference to FIGS. 1 through 7.

Figure 1:
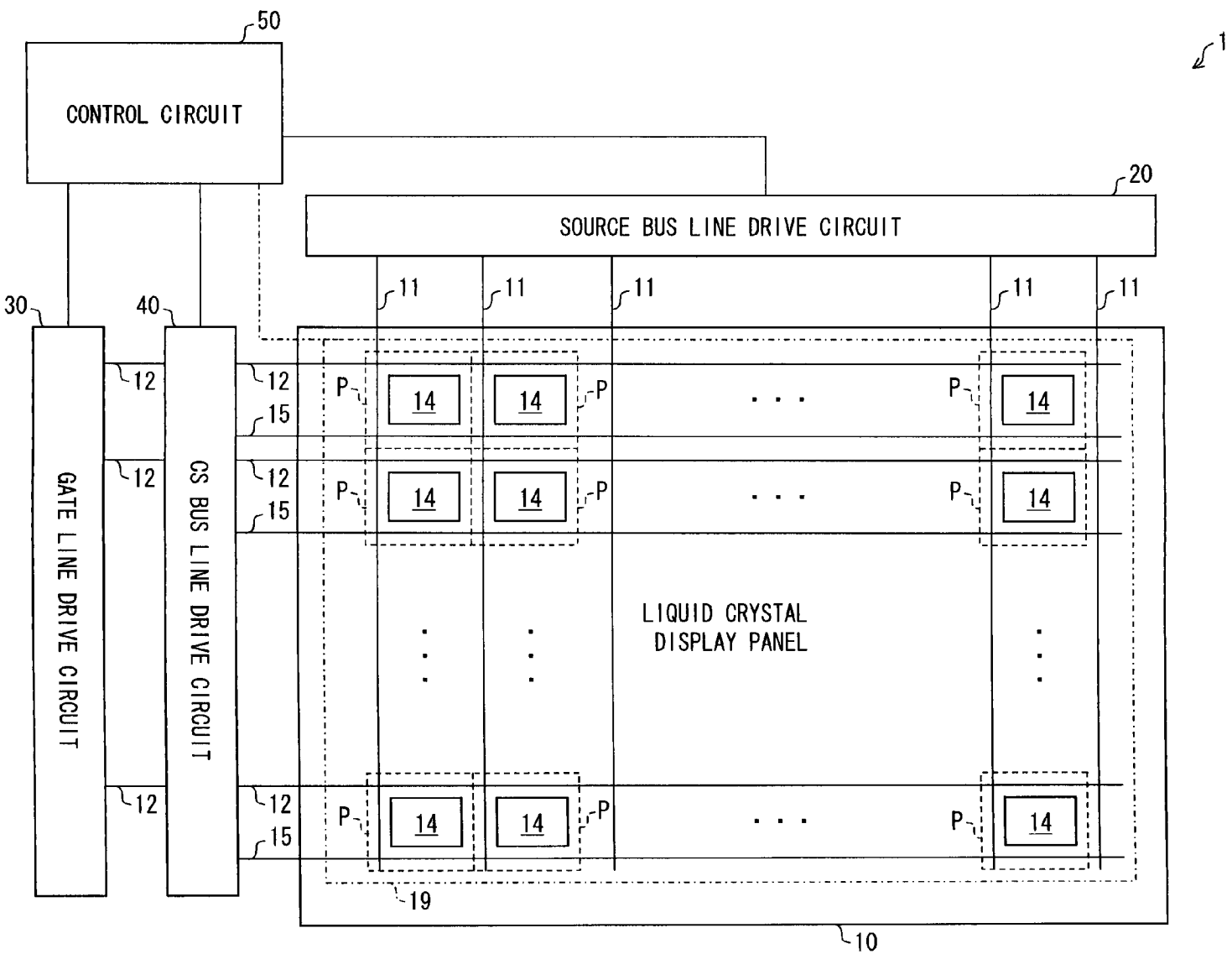
FIG. 1 is a block diagram showing the structure of a liquid crystal display device according to one embodiment of the present invention.
Figure 2:
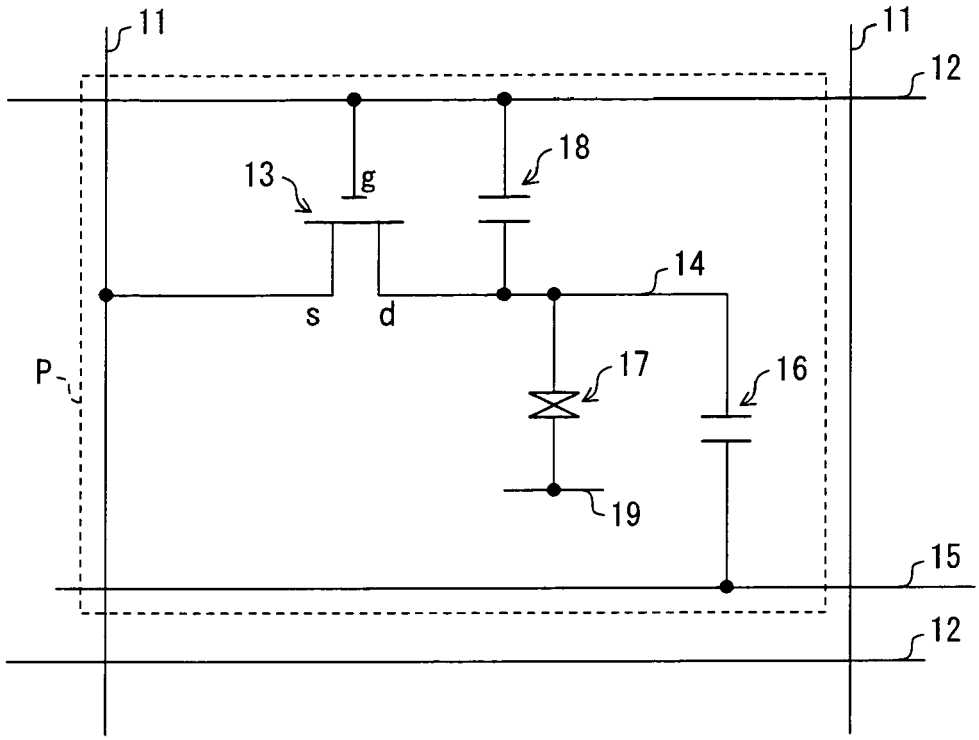
FIG. 2 is an equivalent circuit diagram showing an electrical structure of a pixel in the liquid crystal display device of FIG. 1.

First, the structure of a liquid crystal display device 1, which is equivalent to a display device of the present invention, is described with reference to FIGS. 1 and 2. Note that FIG. 1 is a block diagram showing an overall structure of the liquid crystal display device 1. FIG. 2 is an equivalent circuit diagram showing an electrical structure of a pixel in the liquid crystal display device 1.

The liquid crystal display device 1 includes an active matrix liquid crystal display panel 10, a source bus line drive circuit 20, a gate line drive circuit 30, a CS bus line drive circuit 40, and a control circuit 50, which respectively correspond to a display panel, a data signal line drive circuit, a scan signal line drive circuit, a capacitive coupling interconnection drive circuit, and a control circuit of the present invention.

The liquid crystal display panel 10 is arranged in such a manner that liquid crystal is sandwiched between an active matrix substrate and a counter substrate (both not shown), and the liquid crystal display panel 10 has a large number of pixels P arranged in a matrix manner.

In the liquid crystal display panel 10, the active matrix substrate has thereon source bus lines 11, gate lines 12, thin film transistors (hereinafter referred to as TFTs) 13, pixel electrodes 14, and CS bus lines 15, which respectively correspond to data signal lines, scan signal lines, switching elements, pixel electrodes, and capacitive coupling interconnections of the present invention, and the counter substrate has disposed thereon a counter electrode 19. Note that the TFT 13 is shown only in FIG. 2 and omitted in FIG. 1.

Each of the source bus lines 11 is provided for each column so as to be parallel to each other in a column direction (longitudinal direction), and each of the gate lines 12 is provided for each row so as to be parallel to each other in a row direction (lateral direction). The TFT 13 and the pixel electrode 14 are provided corresponding to each intersection of the source bus line 11 and the gate line 12. A source electrode s of the TFT 13, a gate electrode g, and a drain electrode d are connected to the source bus line 11, the gate line 12, and the pixel electrode 14, respectively. Between the pixel electrode 14 and the counter electrode 19, a liquid crystal capacitor 17 is provided via liquid crystal.

With this arrangement, a gate signal (scan signal) supplied to the gate line 12 turns on a gate of the TFT 13 and a source signal (data signal) from the source bus line 11 is written to the pixel electrode 14, so that the pixel electrode 14 is adjusted to have a potential corresponding to the source signal. Additionally, a voltage corresponding to the source signal is applied to the liquid crystal interposed between the pixel electrode 14 and the counter electrode 19, so that display is realized at a tone level corresponding to the source signal.

Each of the CS bus lines 15 is provided for each row so as to be parallel to each other in a row direction (lateral direction), and is disposed so as to be paired with the gate line 12. Each of the CS bus lines 15 is capacitively coupled to the pixel electrode 14 disposed on each row. Between each of the CS bus lines 15 and each of the pixel electrodes 14, a retention capacitor (also referred to as "auxiliary capacitor") 16 is provided.

Note that the TFT 13 is structurally provided with a feed-through capacitor 18 between a gate electrode g and a drain electrode d, which makes a potential of the pixel electrode 14 to experience the effect (feed-through phenomenon) of potential level change of the gate line 12. However, for simple explanation, the effect is not considered herein.

The liquid crystal display panel 10 as arranged above is driven by the source bus line drive circuit 20, the gate line drive circuit 30, a CS bus line drive circuit 40, and a control circuit 50, which controls these circuits. The above circuits correspond to display drive circuits of the present invention.

In the present embodiment, horizontal scanning periods of the respective rows are sequentially allocated in an active period (effective scanning period) of a vertical scanning period repeated cyclically, and the rows are scanned sequentially.

With this arrangement, the gate line drive circuit 30 sequentially outputs, in sync with the horizontal scanning period for each of the rows, a gate signal for turning on the TFT 13 with respect to the gate line 12 on one row.

The source bus line drive circuit 20 outputs a source signal to each of the source bus lines 11. The source signal is a signal which is formed by allocating a video signal, which is supplied from the outside of the liquid crystal display device 1 to the source bus line drive circuit 20 via the control circuit 50, with respect to the separate source lines in the source bus line drive circuit 20 and then subjecting each of the resulting signals to multiplying or the like treatment. Further, the source bus line drive circuit 20 performs the so-called line inversion driving by reversing the polarity of the source signal to be outputted in sync with a horizontal scanning period for each of the rows, while making the polarity opposite in an adjacent horizontal scanning period on the same row. For example, a polarity of the source signal in the horizontal scanning period on the first row is reversed with respect to a polarity of the source signal in the horizontal scanning period on the second row, and the polarity of the source signal in the horizontal scanning period of the first row in the first frame is opposite to the polarity of the source signal in the horizontal scanning period of the first row in the second frame (see FIG. 3 described later).

The CS bus line drive circuit 40 outputs a CS signal, which corresponds to a potential shift signal of the present invention, to each of the CS bus lines 15. A potential of the CS signal is switched between two potential levels (rises or falls) and controlled so that the potential of the CS signal at a time of on-to-off switching of the TFT 13 on the one row is different from a potential of the CS signal on an adjacent row. The CS bus line drive circuit 40 will be described later in detail.

Under control of the control circuit 50, the gate line drive circuit 30, the source bus line drive circuit 20, and the CS bus line drive circuit 40, which are all described above, output signals shown in FIG. 3.

The present invention especially features the CS bus line drive circuit in the liquid crystal display device 1 constituted by the foregoing components. First and Second Embodiments will describe details of the CS bus line drive circuit 40 and a CS bus line drive circuit 40', respectively. Note that First and Second Embodiments describe the liquid crystal display device 1 including the CS bus line drive circuit 40 and the liquid crystal display device 1 including the CS bus line drive circuit 40', respectively.

[First Embodiment]

Figure 3:
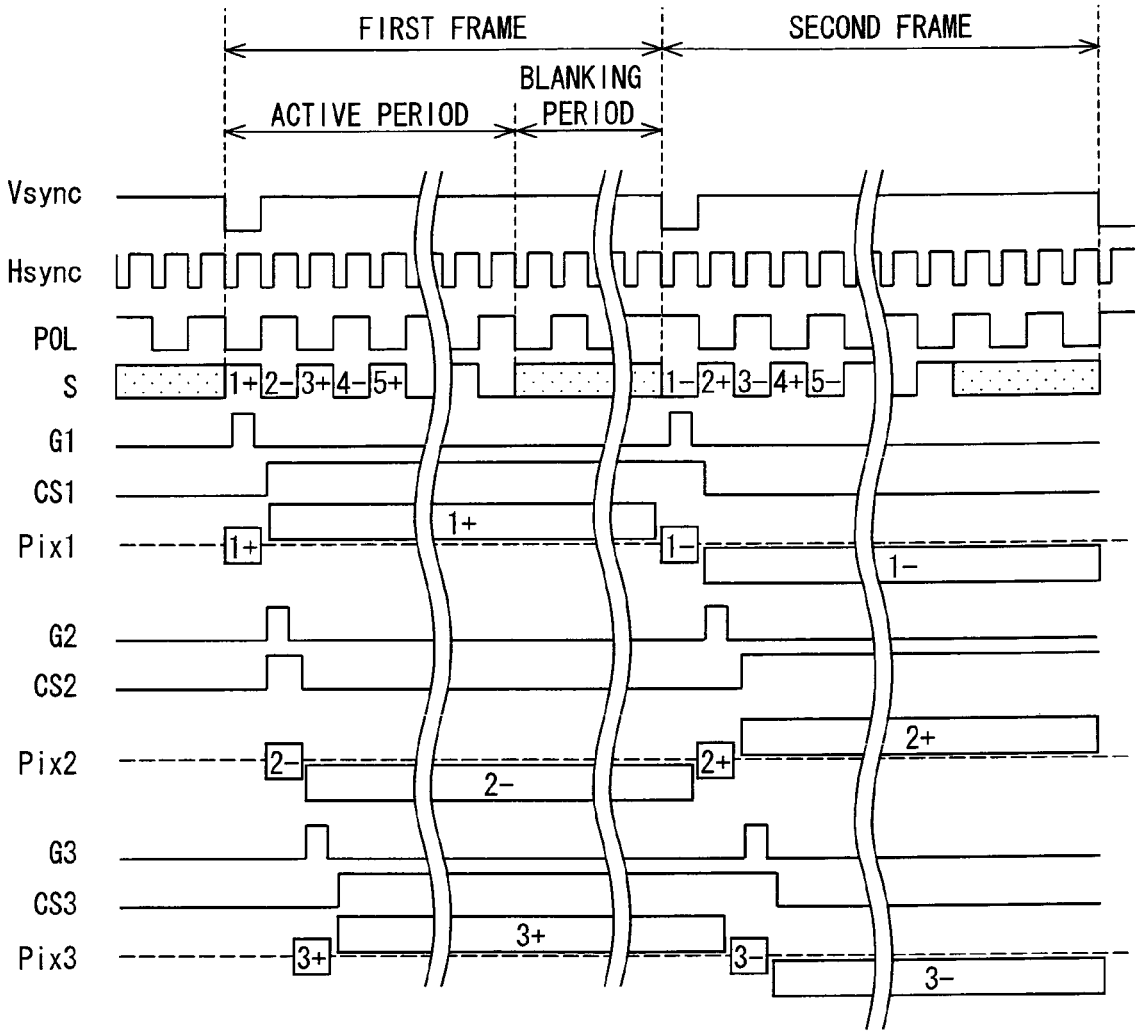
FIG. 3 is a timing chart showing waveforms of various kinds of signals in a liquid crystal display device in First Embodiment.

FIG. 3 is a timing chart showing waveforms of various kinds of signals in the liquid crystal display device 1 of First Embodiment. In FIG. 3, as in FIG. 10, Vsync represents a vertical sync signal that defines a timing of vertical scanning, and Hsync represents a horizontal sync signal that defines a timing of horizontal scanning. A duration between a first rise and a second rise of Vsync is one vertical scanning period (1V period), and a duration between a first fall and a second fall of Hsync is one horizontal scanning period (1H period). POL represents a polarity signal of which polarity reverses in sync with the horizontal scanning period.

FIG. 3 illustrates the followings in this order: a source signal S that is supplied from the source bus line drive circuit 20 to a certain source bus line 11 (source bus line 11 provided on an x-th column); a gate signal G1 that is supplied from the gate line drive circuit 30 to a gate line 12 provided on a first row; a CS signal CS1 that is supplied from the CS bus line drive circuit 40 to a CS bus line 15 on a first row; and a potential waveform Pix1 of the pixel electrode 14 provided on the first row and on the x-th column. Further, FIG. 3 illustrate the followings in this order: a gate signal G2 that is supplied to the gate line 12 provided on the second row, a CS signal CS2 that is supplied to the CS bus line 15 provided on the second row, and a potential waveform Pix2 of the pixel electrode 14 provided on the second row and on the x-th column. Still further, FIG. 3 illustrates the followings in this order: a gate signal G3 that is supplied to the gate line 12 provided on the third row, a CS signal CS3 that is supplied to the CS bus line 15 provided on the third row, and a potential waveform Pix3 of the pixel electrode 14 provided on the third row and on the x-th column. Note that dashed lines in the potential waveforms Pix1, Pix2, and Pix3 represent potentials of the counter electrode 19.

In the timing chart of FIG. 3, a first frame, which follows after the liquid crystal display device 1 starts operating upon its activation or the like, is a start frame of a display corresponding to a video image to be displayed (hereinafter such display is referred to as "video image display"), and a period before the first frame is a period in an initial state where video image display is not carried out.

Figure 10:
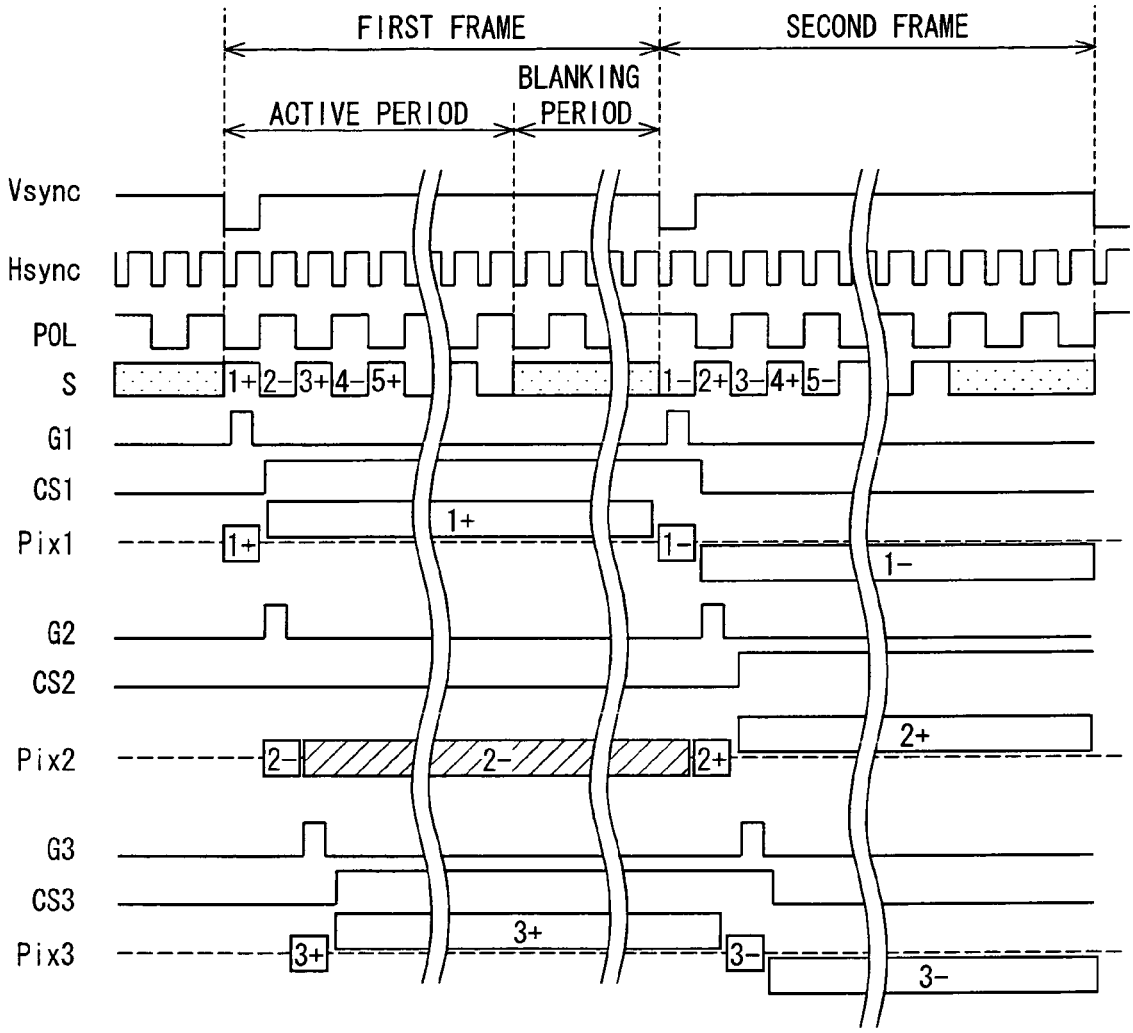
FIG. 10 is a timing chart showing a comparative example of waveforms of various kinds of signals in a liquid crystal display device.

In First Embodiment, as shown in FIG. 3, in the initial state, as with the case in FIG. 10, polarities of the CS signals CS1, CS2, and CS3 are all fixed to one potential (low level in FIG. 3), but the polarity of the CS signal CS2 is switched from low level to high level in sync with the rise of the corresponding gate signal G2, and the CS signal CS2 is in high level at the fall of the gate signal G2. Therefore, the potential of the CS signal on each row at the time of fall of the corresponding gate signal is different from the potential of the CS signal on an adjacent row. For example, the CS signal CS1 is in low level at the time of fall of the corresponding gate signal G1, the CS signal CS2 is in high level at the time of fall of the corresponding gate signal G2, and the CS signal CS3 is in low level at the time of fall of the corresponding gate signal G3.

Here, the source signal S is a signal that has amplitude corresponding to a tone level defined by a video signal and reverses its polarity every 1H period. Note that since the case of FIG. 3 assumes that a uniform video image is displayed, amplitude of the source signal S is constant in FIG. 3. Further, the gate signals G1, G2, and G3 are at gate-on potentials respectively in the first, second, and third 1H periods of an active period (effective scanning period) of each frame, and the gate signals G1, G2, and G3 are at gate-off potentials in the other periods.

The CS signals CS1, CS2, and CS3 are reversed after the fall of the corresponding gate signals G1, G2, and G3, respectively, and take waveforms such that their reversal directions are opposite to each other. That is, in an odd-numbered frame (first frame, third frame . . . ), the CS signals CS1 and CS3 rise after the fall of the corresponding gate signals G1 and G3, and the CS signal CS2 falls after the fall of the corresponding gate signal G2. In an even-numbered frame (second frame, fourth frame . . . ), the CS signals CS1 and CS3 fall after the fall of the corresponding gate signals G1 and G3, and the CS signals CS2 rise after the fall of the corresponding gate signal G2 (In the above descriptions, the odd-numbered frame and the even-numbered frame are used interchangeably).

In the timing chart of FIG. 3, the potentials of the CS signals on the adjacent rows are different from each other at the fall of the gate signal in the first frame, which cause the CS signals CS1, CS2, and CS3 in the first frame take the same waveforms as those in a normal odd-numbered frame (e.g. third frame). Therefore, all of the potential waveforms Pix1, Pix2, and Pix3 of the pixel electrode 14 are properly shifted by the CS signals CS1, CS2, and CS3, respectively. This allows potential differentials between the potential of the counter electrode and the potential of the pixel electrode 14 after the shift to be identical to each other in positive and negative polarities, when the source signals S of the same tone level is inputted. This, in turn, eliminates the occurrence of lateral stripes in the first frame, which allows for improvement of display quality.

(Structure of the Cs Bus Line Drive Circuit 40)

As described previously, in the CS bus line drive circuit 40 in First Embodiment, the CS signal CS2 is switched from low level to high level in sync with the rise of the corresponding gate signal G2 in the first frame. In this manner, the CS signal is switched from low level to high level on alternate rows (CS2, CS4, . . . ) in sync with the rise of the corresponding gate signal. This causes the potential of the CS signal on each row to be different from the potential of the CS signal on an adjacent row at the fall of the corresponding gate signal.

Here, the following will describe a specific structure of the CS bus line drive circuit 40 for realizing the above-described control.

Figure 4:
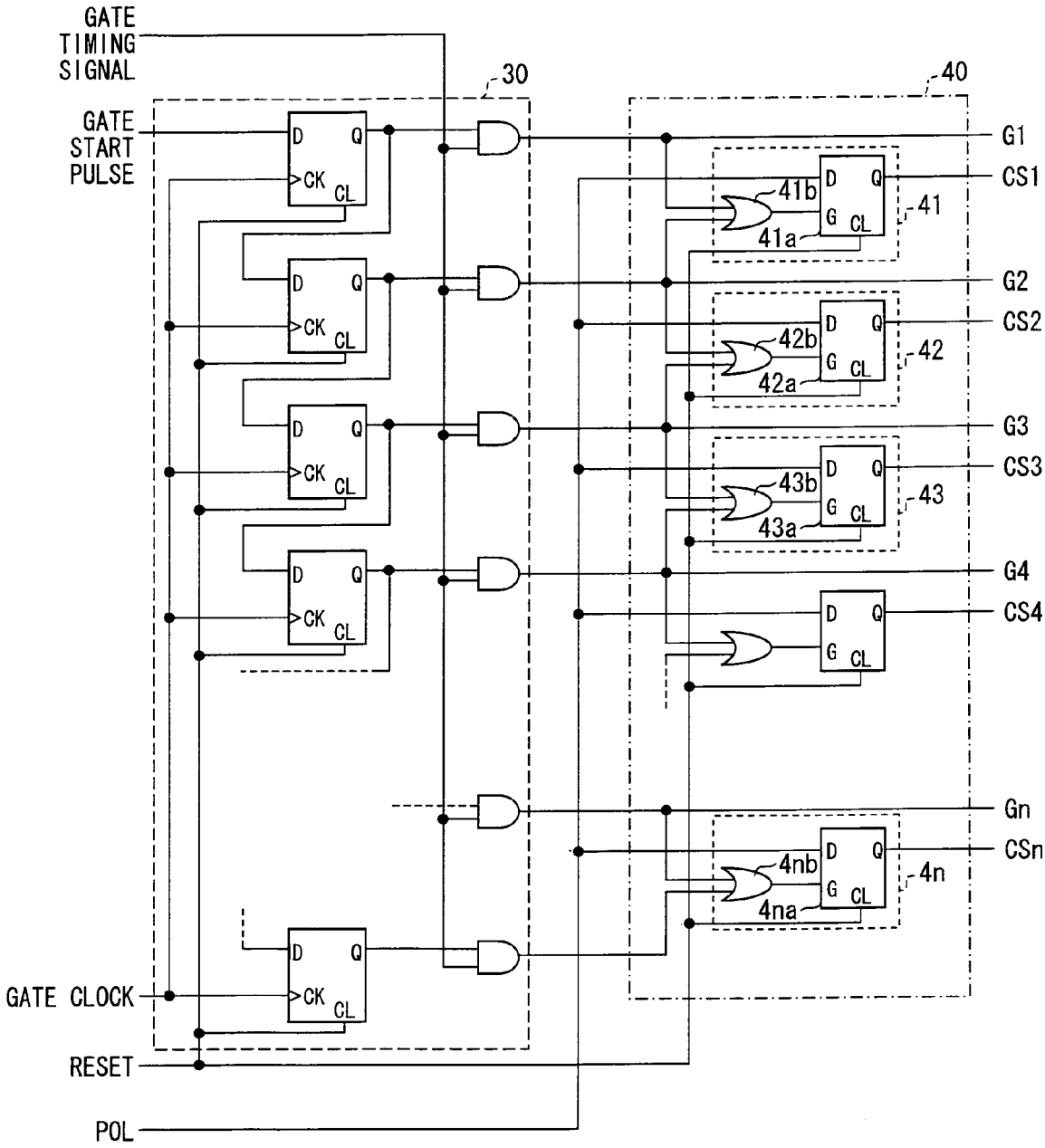
FIG. 4 is a block diagram showing the structure of a CS bus line drive circuit in First Embodiment.

In order to realize the above-described control, the CS bus line drive circuit 40 is provided therein with a plurality of circuits 41, 42, 43, . . . 4*n*, shown in FIG. 4, corresponding to the respective rows.

Each of the circuits 41, 42, 43, . . . 4*n* includes D-latch circuits 41*a*, 42*a*, 43*a*, . . . , 4*na* and OR circuits 41*b*, 42*b*, 43*b*, . . . , 4*nb*. For convenience of explanation, the following descriptions exemplify the circuits 41 and 42 respectively corresponding to the first and second rows.

Signals inputted to the circuit 41 are gate signals G1 and G2, a polarity signal POL, and a reset signal RESET. The signals inputted to the circuit 42 are gate signals G2 and G3, a polarity signal POL, and a reset signal RESET. The polarity signal POL and the reset signal RESET are sent from the control circuit 50 thereto.

To a terminal CL, a terminal D (second input section), and a terminal G (first input section) of the D-latch circuit 41*a*, the reset signal RESET, the polarity signal POL, and output of the OR circuit 41*b* are inputted, respectively. The D-latch circuit 41*a* outputs, as a CS signal CS1 indicative of potential level change, an input state (low level or high level) of the polarity signal POL inputted to the terminal D, according to a potential level change (low level to high level or high level to low level) of the signal inputted to the terminal G. Specifically, the D-latch circuit 41*a* outputs an input state (low level or high level) of the polarity signal POL inputted to the terminal D when the potential level of the signal inputted to the terminal G is in high level. When the potential level of the signal inputted to the terminal G changes from high level to low level, the D-latch circuit 41*a* latches the input state (low level or high level) of the polarity signal POL inputted to the terminal D at the time of the potential level change, and maintains a latched state until the potential level of the subsequent signal inputted to the terminal G is changed to high level. Then, from a terminal Q of the D-latch circuit 41*a*, the CS signal CS1 indicative of potential level change is outputted.

Similarly, to the terminals CL and D of the D-latch circuit 42*a*, the reset signal RESET and the polarity signal POL are inputted, respectively. To the terminal G, output of the OR circuit 42*b* is inputted. This causes the CS signal CS2 indicative of potential level change to be outputted from the terminal Q (output section) of the D-latch circuit 42*a*.

Figure 5:
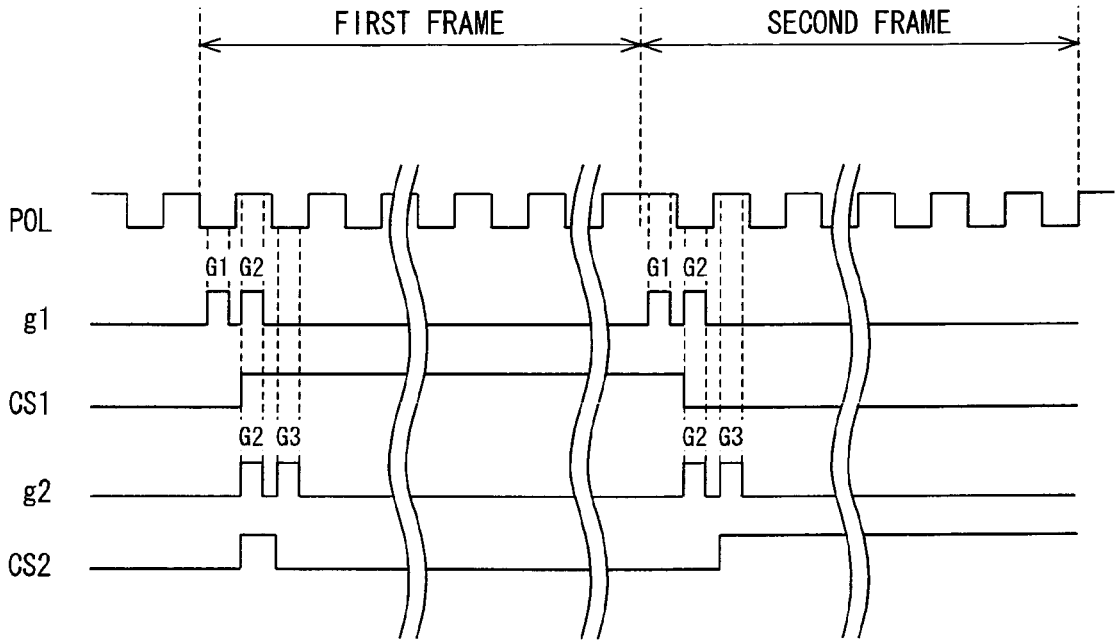
FIG. 5 is a timing chart showing waveforms of various kinds of signals inputted to or outputted from the CS bus line drive circuit in First Embodiment.

The OR circuit 41*b*, upon receipt of the gate signal G1 of the corresponding gate line 12 and the gate signal G2 of the gate line 12 on the subsequent row, outputs a signal g1 shown in FIG. 5. Further, the OR circuit 42*b*, upon receipt of the gate signal G2 of the corresponding gate line 12 and the gate signal G3 of the gate line 12 on the subsequent row, outputs a signal g2 shown in FIG. 5. Note that a gate signal inputted to each OR circuit is generated by the gate line drive circuit 30 including a D-type flip-flop circuit, shown in FIG. 4, by a well-known method, and specific explanations thereof are therefore omitted.

FIG. 5 is a timing chart showing waveforms of various kinds of signals inputted to or outputted from the CS bus line drive circuit 40 of the liquid crystal display device 1.

First, changes in waveforms of various kinds of signals on the first row will be described. In the initial state, the polarity signal POL and the reset signal RESET are inputted respectively to the terminals D and CL of the D-latch circuit 41*a* in the circuit 41. By virtue of the reset signal RESET, the potential level of the CS signal CS1 outputted from the terminal Q of the D-latch circuit 41*a* is maintained low level. Thereafter, the gate signal G1 is supplied to the gate line 12 on the first row from the gate line drive circuit 30, and the gate signal G1 is concurrently inputted to one terminal of the OR circuit 41*b* in the circuit 41. Then, the signal g1 indicative of potential level change (from low level to high level) of the gate signal G1 is inputted to the terminal G, and an input state of the polarity signal POL inputted to the terminal D at the point in time, i.e. low level is transferred, and the polarity signal in low level is outputted until there occurs subsequent potential level change (from high level to low level) of the gate signal G1 in the signal g1 to be inputted to the terminal G (during a period in which the signal g1 is in high level). Next, potential level change (high level to low level) of the gate signal G1 in the signal g1 is inputted to the terminal G, an input state of the polarity signal POL at the point in time, i.e. low level is latched. Thereafter, the low level is maintained until the level of the signal g1 is changed to high level.

Next, to the other terminal of the OR circuit 41*b*, the gate signal G2 shifted to the second row by the gate line drive circuit 30 is inputted. Note that the gate signal G2 is further supplied to the gate line 12 on the second row and inputted to one terminal of the OR circuit 42*b* in the circuit 42.

Then, to the terminal G of the D-latch circuit 41*a*, potential level change (from low level to high level) of the gate signal G2 in the signal g1 is inputted, and an input state of the polarity signal POL inputted to the terminal D at the point in time, i.e. a high level is transferred to the terminal G. That is, at the timing when the gate signal G2 change its potential level (from low level to high level), the potential level of the CS signal CS1 is changed from low level to high level. Until there occurs subsequent potential level change (high level to low level) of the gate signal G2 in the signal g1 to be inputted to the terminal G (during a period in which the signal g1 is in high level), the CS signal CS1 in high level is outputted. Next, when the signal g1 indicative of the potential level change (from high level to low level) of the gate signal G2 is inputted to the terminal G, the input state of the polarity signal POL at the point in time, i.e. high level of the polarity signal POL is latched. Thereafter, the high level of the polarity signal POL is maintained until the level of the signal g1 is changed to high level in the second frame.

In the second frame, during a period in which the signal g1 indicates that the gate signal G1 is in high level, after the input state (high level) of the polarity signal POL inputted to the terminal D is transferred, the input state (high level) of the polarity signal POL at the receipt of potential level change (from high level to low level) of the gate signal G1 is latched, and the polarity signal POL in high level is maintained until the level of the signal g1 is changed to high level.

Next, to the terminal G of the D-latch circuit 41*a*, potential level change (low level to high level) of the gate signal G2 is inputted, and an input state of the polarity signal POL inputted to the terminal D at the point in time, i.e. low level is transferred. That is, at the timing of the potential level change (from low level to high level) of the gate signal G2, the potential of the CS signal CS1 is changed from high level to low level. Then, until there occurs subsequent potential level change (from high level to low level) of the gate signal G2 inputted to the terminal G (during a period in which the signal g1 is in high level), the CS signal CS1 in low level is outputted. Next, when the potential level change (from high level to low level) of the gate signal G2 is inputted to the terminal G, an input state of the polarity signal POL at the point in time, i.e. low level is latched. Thereafter, the low level is maintained until the level of the signal g1 is changed to high level in the third frame. In the third frame and its subsequent frames, the operations in the first frame and the second frame are repeated alternately.

Secondly, the following will describe changes in waveforms of various kinds of signals on the second row. In the initial state, the polarity signal POL and the reset signal RESET are inputted respectively to the terminals D and CL of the D-latch circuit 42*a* in the circuit 42. In virtue of the reset signal RESET, the potential level of the CS signal CS2 outputted from the terminal Q of the D-latch circuit 42*a* is maintained low level. Thereafter, as described previously, the gate signal G2 is supplied to the gate line 12 on the second row from the gate line drive circuit 30, and the gate signal G2 is concurrently inputted to one terminal of the OR circuit 42*b* in the circuit 42. Then, potential level change (from low level to high level) of the gate signal G2 in the signal g2 is inputted to the terminal G, and an input state of the polarity signal POL inputted to the terminal D at the point in time, i.e. high level is transferred. That is, at the timing of the potential level change (from low level to high level) of the gate signal G2, the potential of the CS signal CS2 is changed from low level to high level. Until there occurs subsequent potential level change (from high level to low level) of the gate signal G2 in the signal g2 to be inputted to the terminal G (during a period in which the signal g2 is in high level), the CS signal CS2 in high level is outputted. Next, when potential level change (high level to low level) of the gate signal G2 in the signal g2 is inputted to the terminal G, an input state of the polarity signal POL at the point in time, i.e. high level is latched. Thereafter, the high level is maintained until the level of the signal g2 is changed to high level.

Next, to the other terminal of the OR circuit 42*b*, the gate signal G3 shifted to the third row by the gate line drive circuit 30 is inputted. Note that the gate signal G3 is further supplied to the gate line 12 on the third row and inputted to one terminal of the OR circuit 43*b* in the circuit 43.

Then, to the terminal G of the D-latch circuit 42*a*, potential level change (from low level to high level) of the gate signal G3 in the signal g2 is inputted, and an input state of the polarity signal POL inputted to the terminal D at the point in time, i.e. low level is transferred. That is, at the timing of the potential level change (from low level to high level) of the gate signal G3, the potential level of the CS signal CS2 is changed from high level to low level. Then, until there occurs subsequent potential level change (from high level to low level) of the gate signal G3 in the signal g2 inputted to the terminal G (during a period in which the signal g2 is in high level), the CS signal CS2 in low level is outputted. Next, when the potential level change (high level to low level) of the gate signal G3 in the signal g2 is inputted to the terminal G, an input state of the polarity signal POL at the point in time, i.e.

low level is latched. Thereafter, the low level is maintained until the level of the signal g2 is changed to high level in the second frame.

In the second frame, during a period in which the signal g2 indicates that the gate signal G2 is in high level, after the input state (low level) of the polarity signal POL inputted to the terminal D is transferred, the input state (low level) of the polarity signal POL when the potential level change (high level to low level) of the gate signal G2 is inputted is latched, and the low level is maintained until the level of the signal g2 is changed to high level.

Next, to the terminal G of the D-latch circuit 42*a*, potential level change (from low level to high level) of the gate signal G3 is inputted, and an input state of the polarity signal POL inputted to the terminal D, i.e. high level is transferred. That is, at the timing of the potential level change (low level to high level) of the gate signal G3, the potential of the CS signal CS2 is changed from low level to high level. Then, until there occurs subsequent potential level change (high level to low level) of the gate signal G3 inputted to the terminal G (during a period in which the signal g2 is in high level), the CS signal CS2 in high level is outputted. Next, when the potential level change (high level to low level) of the gate signal G3 is inputted to the terminal G, the input state of the polarity signal POL at the point in time, i.e. high level is latched. Thereafter, the high level is maintained until the level of the signal g2 is changed to high level in the third frame.

Note that the operation in the second frame on the second row is similar to that in the first frame on the first row. In the third frame and the subsequent frames on the second row, the operations in the second and third frames on the first row are repeated alternately. Additionally, the foregoing operations on the first and second rows are operations on the odd-numbered row and the even-numbered row.

In this manner, the circuits 41, 42, 43, . . . 4*n* corresponding to the respective rows cause the CS signals on the adjacent rows to be outputted so as to have mutually different potentials at the time of the fall of the gate signal on the one row (at the time when the TFT 13 is changed from on-state to off-state) in all of the frames. That is, in First Embodiment, the CS signal outputted to the CS bus line 15 on the n-th row is generated by latching a potential level of the polarity signal POL at the rise of a gate signal Gn on the n-th row and a potential level of the polarity signal POL at the rise of a gate signal G(n+1) on the (n+1)th row. This makes it possible to properly operate the CS bus line drive circuit 40 in the first frame, which eliminates the above-described irregular waveforms that causes lateral stripes in the first frame. This yields the effect of preventing the occurrence of the lateral stripes in the first frame for improvement of display quality.

Note that the CS bus line drive circuit 40 in First Embodiment may be incorporated into the existing gate line drive circuit 30. Alternatively, the CS bus line drive circuit 40 may be provided outside the gate line drive circuit 30 so as to be connected to the gate line drive circuit 30.

[Second Embodiment]

Another embodiment of the present invention will be described below with reference to FIGS. 6 and 7. Note that for convenience of explanation, members having the same functions as those described in First Embodiment are given the same reference numerals and explanations thereof are omitted here. Additionally, the terms defined in First Embodiment are also used as they are in Second Embodiment unless otherwise specified.

Figure 6:
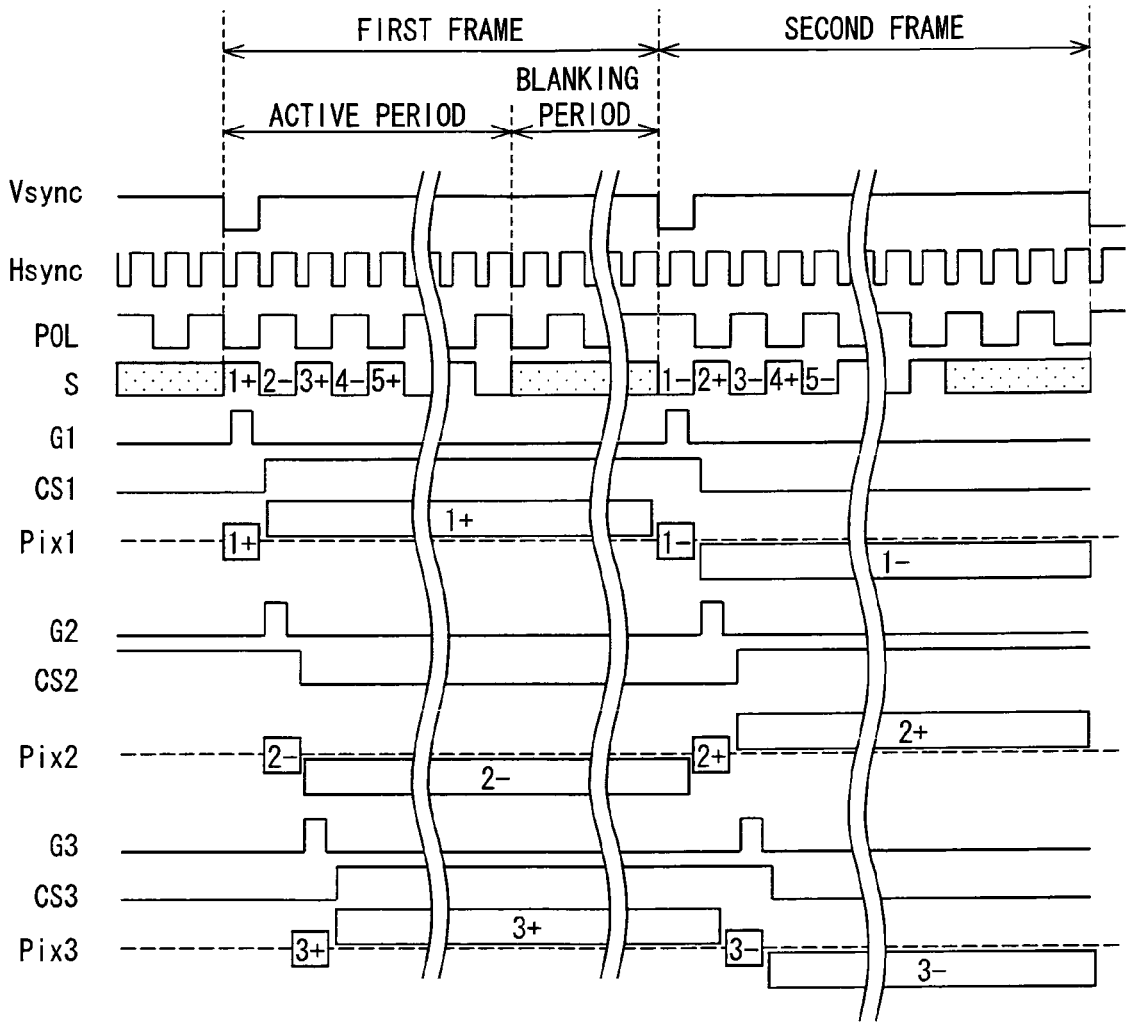
FIG. 6 is a timing chart showing waveforms of various kinds of signals in a liquid crystal display device in Second Embodiment.

FIG. 6 is a timing chart showing waveforms of various kinds of signals of the liquid crystal display device 1 in Second Embodiment. In FIG. 6, potential levels of the CS signals on the respective rows in the initial state are not fixed to one potential level (low level), unlike the fixed potential levels in FIG. 3 corresponding to the descriptions in First Embodiment, and the CS signals on the respective rows in the initial state take different potential levels (low level or high level) on alternate rows. That is, the potential levels of the CS signals CS1 and CS3 outputted to the CS bus lines 15 on the first and third rows in the initial state are low levels, but the potential level of the CS signal CS2 outputted to the CS bus line 15 on the second row in the initial state is high level.

The CS signals CS1, CS2, and CS3 reverse after the falls of the corresponding gate signals G1, G2, and G3, respectively, and take waveforms such that their reversal directions are opposite to each other. That is, in an odd-numbered frame (first frame, third frame . . . ), the CS signals CS1 and CS3 rise after the fall of the corresponding gate signals G1 and G3, and the CS signal CS2 falls after the fall of the corresponding gate signal G2. In an even-numbered frame (second frame, fourth frame . . . ), the CS signals CS1 and CS3 fall after the fall of the corresponding gate signals G1 and G3, and the CS signals CS2 rise after the fall of the corresponding gate signal G2 (In the above descriptions, the odd-numbered frame and the even-numbered frame are interchangeable).

In the timing chart of FIG. 6, the potentials of the CS signals on the adjacent rows are mutually different from each other not only at the fall of the gate signal in the first frame but also in the initial state, which cause the CS signals CS1, CS2, and CS3 in the first frame to take the same waveforms as those in a normal odd-numbered frame (e.g. third frame). Therefore, all of the potential waveforms Pix1, Pix2, and Pix3 of the pixel electrode 14 are properly shifted by the CS signals CS1, CS2, and CS3, respectively. This allows potential differentials between the potential of the counter electrode and the potential of the pixel electrode 14 after the shift to be identical to each other in positive and negative polarities, when the source signals S of the same tone level is inputted. This, in turn, eliminates the occurrence of lateral stripes in the first frame, which allows for improvement of display quality.

(Structure of the Cs Bus Line Drive Circuit 40')

In a CS bus line drive circuit 40' of Second Embodiment, as described previously, the CS signals on the respective rows in the initial state take different potential levels on alternate rows.

Figure 7:
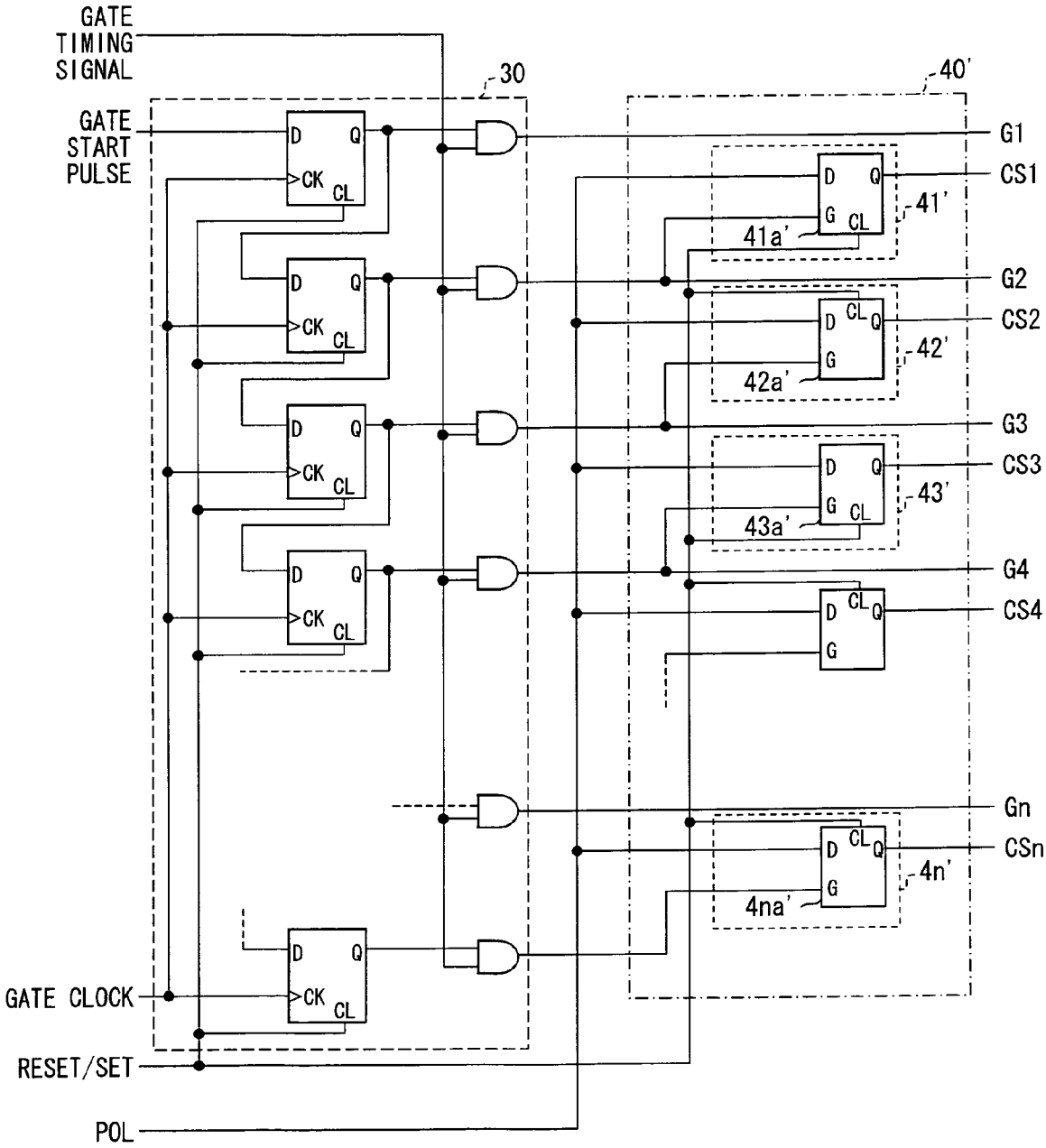
FIG. 7 is a block diagram showing the structure of a CS bus line drive circuit in Second Embodiment.
Figure 8:
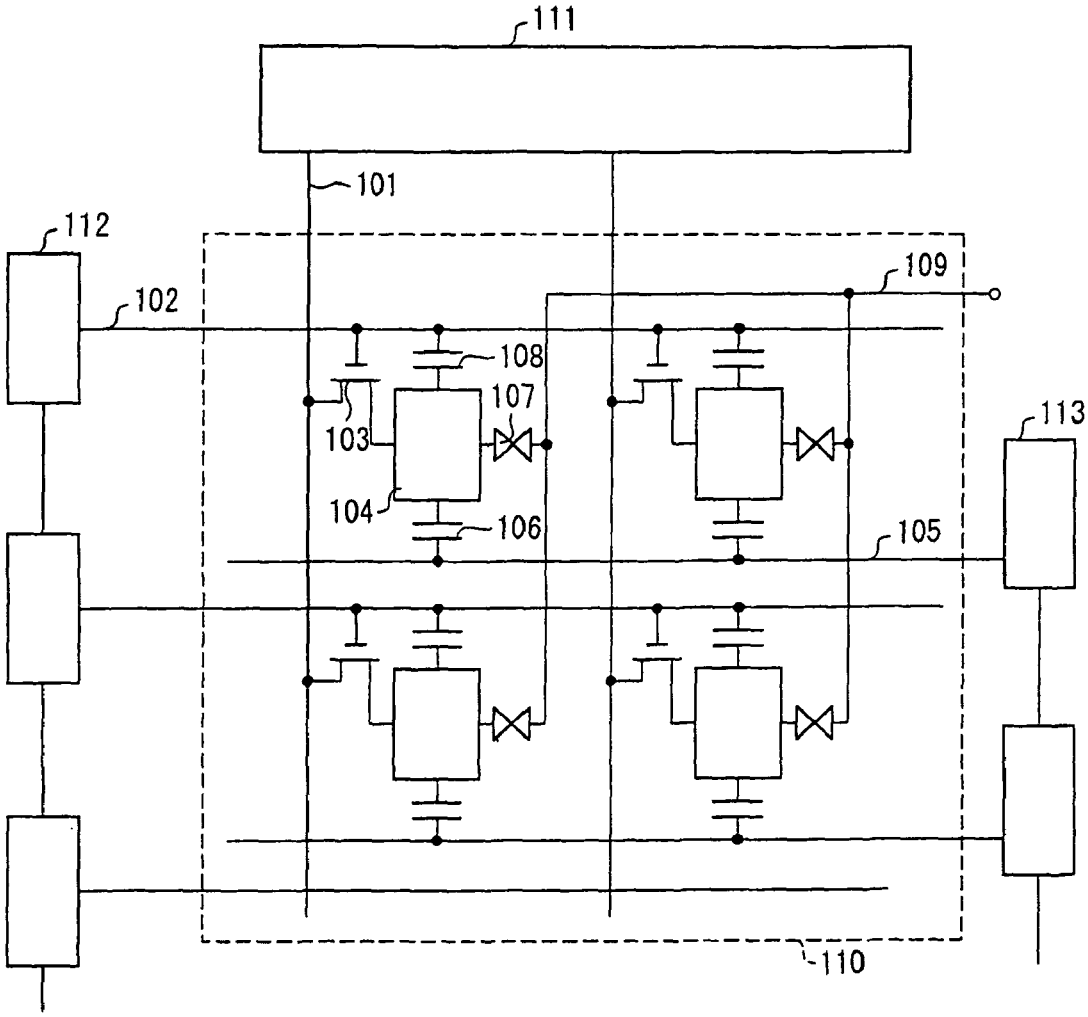
PRIOR ART FIG. 8
FIG. 8 is a block diagram showing the structure of the conventional liquid crystal display device performing the CC driving.
Figure 9:
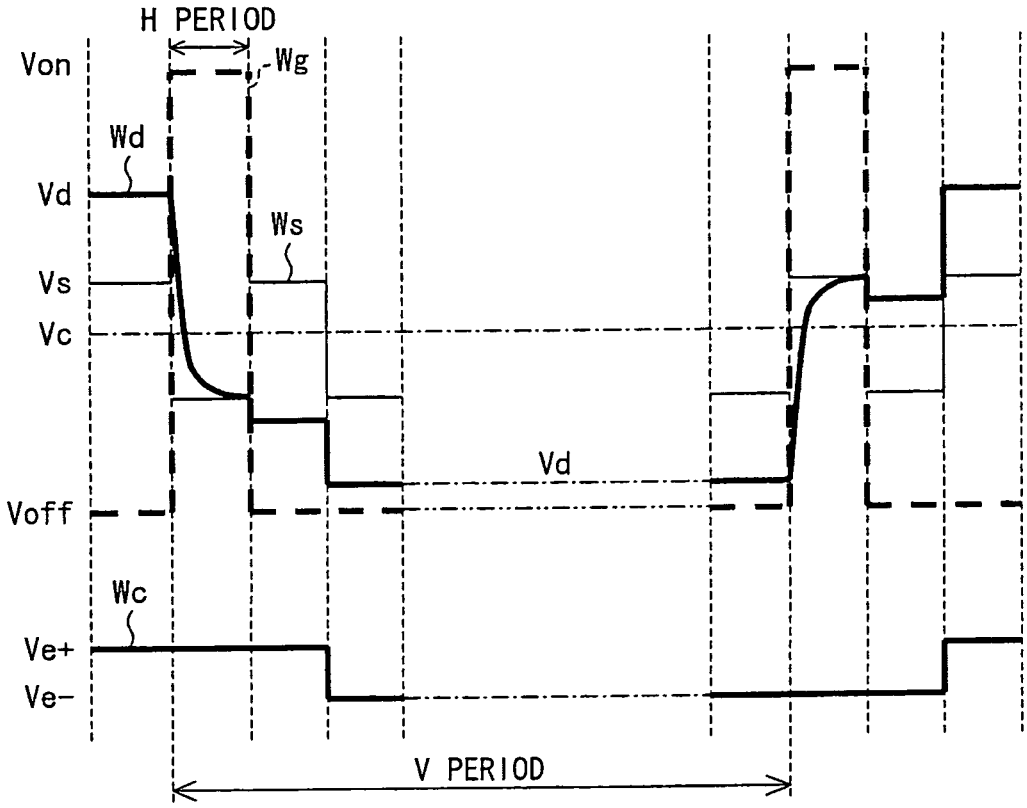
FIG. 9 is a timing chart showing waveforms of various kinds of signals in the conventional CC driving.

Here, a specific structure of the CS bus line drive circuit 40' for realizing the above-described control In order to realize the above-described control, the CS bus line drive circuit 40' is provided therein with a plurality of circuits 41', 42', 43', . . . 4*n*', shown in FIG. 7, corresponding to the respective rows in the CS bus line drive circuit 40'.

Each of the circuits 41', 42', 43', . . . 4*n*' includes D-latch circuits 41*a*', 42*a*', 43*a*', . . . , 4*na*'. For convenience of explanation, the following descriptions exemplify the circuits 41' and 42' respectively corresponding to the first and second rows.

Signals inputted to the circuit 41' are a gate signal G2, a polarity signal POL, and a reset signal RESET (first control signal). Signals inputted to the circuit 42' are a gate signal G3, a polarity signal POL, and a reset signal RESET (second control signal). The polarity signal POL and the reset signal RESET are sent from the control circuit 50 thereto.

To a terminal CL, a terminal D (second input section), and a terminal G (first input section) of the D-latch circuit 41*a*', the reset signal RESET, the polarity signal POL, and a gate signal G2 of the gate line 12 on the subsequent row are inputted, respectively. From a terminal Q (output section) of the D-latch circuit 41*a*', a CS signal CS1 indicative of potential level change is outputted.

Further, to the terminal CL, a terminal D, and a terminal G of the D-latch circuit 42*a*', a set signal SET, a polarity signal POL, a gate signal G3 of the gate line 12 on the subsequent row are inputted, respectively. From a terminal Q of the D-latch circuit 42*a*', a CS signal CS2 indicative of potential level change is outputted.

Note that basic operations of the D-latch circuits 41*a*' and 42*a*' are similar to the basic operation of the D-latch circuit 41*a*.

With reference to FIG. 6, the following will describe changes in waveforms of various kinds of signals inputted to or outputted from the CS bus line drive circuit 40' of the liquid crystal display device 1.

First, changes in waveforms of various kinds of signals on the first row will be described. The operation in the first frame on the first row is the same as the operation described above in First Embodiment. That is, in the initial state, the polarity signal POL and the reset signal RESET are inputted respectively to the terminals D and CL of the D-latch circuit 41*a*' in the circuit 41'. By virtue, of the reset signal RESET, the potential level of the CS signal CS1 outputted from the terminal Q of the D-latch circuit 41*a*' is maintained low level. Thereafter, the gate signal G2 is inputted to the terminal G from the gate line drive circuit 30, and an input state (high level) of the polarity signal POL at the point in time is transferred. That is, at the timing of the potential level change (from low level to high level) of the gate signal G2, the potential level of the CS signal CS1 is changed from low level to high level. The CS signal CS1 in high level is outputted until there occurs subsequent potential level change (from high level to low level) of the gate signal G2 to be inputted to the terminal G (during a period in which the gate signal G2 is in high level). Next, when the potential level change (from high level to low level) of the gate signal G2 is inputted to the terminal G, an input state (high level) of the polarity signal POL at the point in time is latched. Thereafter, the high level of the polarity signal POL is maintained until the level of the gate signal G2 is changed to high level in the second frame.

In the second frame, high level of the polarity signal POL is maintained until there occurs potential level change of the gate signal G2, and when the level of the gate signal G2 inputted to the terminal G of the D-latch circuit 41*a*' is changed from low level to high level, an input state (low level) of the polarity signal POL at the point in time is transferred. That is, at the timing of the potential level change (from low level to high level) of the gate signal G2, the potential level of the CS signal CS1 is changed from high level to low level. The CS signal CS1 in low level is outputted until there occurs subsequent potential level change (from high level to low level) of the gate signal G2 to be inputted to the terminal G (during a period in which the gate signal G2 is in high level). Next, when the potential level change (from high level to low level) of the gate signal G2 is inputted to the terminal G, an input state (low level) of the polarity signal POL at the point in time is latched. Thereafter, the low level of the polarity signal POL is maintained until the level of the gate signal G2 is changed to high level in the third frame. In the third frame and subsequent frames, the operations in the first frame and the second frame are repeated alternately.

Secondly, the following will describe changes in waveforms of various kinds of signals on the second row. The operation in the first frame on the second row is similar to the above-described operation in the second frame on the first row. That is, in the initial state, the polarity signal POL and the set signal SET are inputted respectively to the terminals D and CL of the D-latch circuit 42*a*' in the circuit 42'. In virtue of the set signal SET, the potential level of the CS signal CS2 outputted from the terminal Q of the D-latch circuit 42*a*' is maintained high level. Thereafter, the gate signal G3 is inputted to the terminal G from the gate line drive circuit 30. Then, potential level change (from low level to high level) of the gate signal G3 is inputted to the terminal G, and an input state of the polarity signal POL inputted to the terminal D at the point in time, i.e. low level is transferred. That is, at the timing of the potential level change (from low level to high level) of the gate signal G3, the potential level of the CS signal CS2 is changed from high level to low level. Until there occurs subsequent potential level change (from high level to low level) of the gate signal G3 to be inputted to the terminal G (during a period in which the gate signal G3 is in high level), the CS signal CS2 in low level is outputted. Next, when potential level change (high level to low level) of the gate signal G3 is inputted to the terminal G, an input state (low level) of the polarity signal POL at the point in time is latched. Thereafter, the low level of the polarity signal POL is maintained until the level of the gate signal G3 is changed to high level.

In the second frame, the low level of the polarity signal POL is maintained until there occurs the potential level change of the gate signal G3, when the level of the gate signal G3 inputted to the terminal G of the D-latch circuit 42*a*' is changed from low level to high level, an input state (high level) of the polarity signal POL at the point in time is transferred. That is, at the timing of the potential level change (from low level to high level) of the gate signal G3, the potential level of the CS signal CS2 is changed from low level to high level. Until there occurs subsequent potential level change (from high level to low level) of the gate signal G3 to be inputted to the terminal G (duration in which the gate signal G3 is in high level), the CS signal CS2 in high level is outputted. Next, when the potential level change (from high level to low level) of the gate signal G3 is inputted to the terminal G, an input state (high level) of the polarity signal POL is latched. Thereafter, the high level of the polarity signal POL is maintained until the level of the gate signal G3 is changed to high level in the third frame. In the third frame and subsequent frames, the operations in the first frame and the second frame are repeated alternately.

The above-described operations on the first row and the second row are operations on each odd-numbered row and each even-numbered row, respectively.

Thus, the circuits 41', 42', 43', . . . , 4*n*' corresponding to the respective rows allow the CS signals to be outputted so that the CS signals on the respective rows in the initial state take different potential levels on alternate rows. This makes it possible to properly operate the CS bus line drive circuit 40 in the first frame, which eliminates the above-described irregular waveforms that causes lateral stripes in the first frame. This yields the effect of preventing the occurrence of the lateral stripes in the first frame for improvement of display quality.

Note that the reset signal RESET and the set signal SET are determined depending upon a level of the polarity signal POL. That is, in a case where the polarity signal POL has a waveform as shown in FIG. 6, the reset signal RESET is inputted to the circuit 41' corresponding to the odd-numbered row (first row, third row, . . . ), and the set signal SET is inputted to the circuit 42' corresponding to the even-numbered row (second row, fourth row, . . . ). Meanwhile, in a case where the polarity signal POL has a waveform that is opposite in level (high level/low level) to the waveform shown in FIG. 6, the set signal SET is inputted to the circuit 41' corresponding to the odd-numbered row, and the reset signal RESET is inputted to the circuit 42' corresponding to the even-numbered row. In this manner, the polarity signal POL is associated with the reset signal RESET and the set signal SET. This arrangement can be made, for example, by presetting the reset signal RESET/set signal SET of the D-latch circuit according the specifications of to the control circuit 50.

Further, in Second Embodiment, the potential level of the CS signal outputted to the CS bus line 15 on the n-th row is changed by latching the potential level of the polarity signal POL at the timing of the rise of the gate signal G(n+1) on the (n+1)th row. However, this is not the only possibility. That is, the timings of the potential level changes of the CS signals only need to be after the horizontal scanning periods for the respective rows, and there may occur a time lag of the expiration of the horizontal scanning period between the respective rows. With this arrangement, the CS bus line drive circuit 40' shifts the potential of the pixel electrode 14 at a given point in time after the horizontal scanning period.

As described above, the display drive circuit of the liquid crystal display device 1 described in First and Second Embodiments is arranged such that the gate line drive circuit 30 outputs, in a horizontal scanning period which is sequentially allocated to each of the rows, the gate signal for turning on the TFTs 13 on one row, the source bus line drive circuit 20 outputs the source signal of which polarity is reversed in sync with the horizontal scanning period for the each of the rows and of which polarity is opposite in an adjacent horizontal scanning period on one and the same row, the CS bus line drive circuit 40 and 40' each outputs, after the horizontal scanning period for the each of the rows, the CS signal of which potential is switched between two potential levels along a direction determined according to the polarity of the source signal in the horizontal scanning period concerned. The CS bus line drive circuit 40 and 40' outputs the CS signal so that a potential of the CS signal at a time of on-to-off switching of the TFT 13 on the one row (at the time of gate-off) is different from a potential of the CS signal on an adjacent row.

With this arrangement, it is possible to properly carry out the potential shift of the pixel electrode 14 in the first frame by the CS signal, and eliminate the occurrence of lateral stripes in the first frame. This allows for improvement of display quality of the liquid crystal display device 1.

As described above, a display drive circuit and display driving method of the present invention is such that the potential shift signal is outputted, in the first vertical scanning period from which output of a data signal corresponding to a video image to be displayed is started, so that a potential of the potential shift signal at the time of on-to-off switching of the switching element on the one row is different from a potential of a potential shift signal on an adjacent row.

The above arrangement and method makes it possible to eliminate the above-described display problem, i.e. the problem that alternating light and dark lateral stripes along the respective rows (lines) in the first vertical scanning period (first frame) from which output of a data signal corresponding to a video image to be displayed is started, and yield the effect of realizing the improvement of display quality.

Specific embodiments or examples implemented in the description of the embodiments only show technical features of the present invention and are not intended to limit the scope of the invention. Variations can be effected within the spirit of the present invention and the scope of the following claims.

INDUSTRIAL APPLICABILITY

The present invention can be favorably applied particularly to driving of an active matrix liquid crystal display device.

The invention claimed is:

1. A display drive circuit for carrying out display with a tone corresponding to a potential of a pixel electrode by driving a display panel including a plurality of rows each including a scan signal line, a switching element that is turned on/off by the scan signal line, the pixel electrode connected to one end of the switching element, and a capacitive coupling interconnection capacitively-coupled to the pixel electrode, and further including a data signal line connected to the other end of the switching element on each of the rows, the display drive circuit comprising:

a scan signal line drive circuit that outputs, in a horizontal scanning period which is sequentially allocated to the each of the rows, a scan signal for turning on the switching element on one row;

a data signal line drive circuit that outputs a data signal of which polarity is reversed in sync with the horizontal scanning period for the each of the rows and of which polarity is opposite in an adjacent horizontal scanning period on one and the same row;

a capacitive coupling interconnection drive circuit that outputs, after the horizontal scanning period for the each of the rows, a potential shift signal of which potential is switched between two potential levels along a direction determined according to the polarity of the data signal in the horizontal scanning period concerned, wherein the capacitive coupling interconnection drive circuit outputs the potential shift signal such that (i) upon activation of the display panel, potentials of potential shift signals on all of the rows are fixed to a same one of the two potential levels and (ii) in a first vertical scanning period following the activation of the display panel, from which output of a data signal corresponding to a video image to be displayed is started, a potential of the potential shift signal at a time of on-to-off switching of the switching element on the one row is different from a potential of a potential shift signal on an adjacent row.

2. The display drive circuit according to claim 1, wherein the capacitive coupling interconnection drive circuit outputs the potential shift signal so that the potential of the potential shift signal on the one row is different between when the switching element on the one row is turned on and when the switching element on a row subsequent to the one row is turned on.

3. The display drive circuit according to claim 2, wherein the capacitive coupling interconnection drive circuit includes: a first input section that receives a scan signal on the one row and a scan signal on a row subsequent to the one row; a second input section that receives a polarity signal of which polarity is reversed in sync with the horizontal scanning period for the each of the rows, the polarity signal corresponding to the potential of the potential shift signal; and an output section that outputs the potential shift signal on the one row, and a first polarity of the polarity signal inputted to the second input section when the scan signal on the one row is inputted to the first input section is outputted as a first potential of the potential shift signal, while a second polarity of the polarity signal inputted to the second input section when the scan signal on the row subsequent to the one row is inputted to the first input section is outputted as a second potential of the potential shift signal.

4. The display drive circuit according to claim 3, wherein the capacitive coupling interconnection drive circuit comprises D-latch circuits.

5. A display device comprising a display drive circuit according to claim 1 and the display panel.

6. The display device according to claim 5, wherein the display device is a liquid crystal display device.

7. A display drive circuit for carrying out display with a tone corresponding to a potential of a pixel electrode by driving a display panel including a plurality of rows each including a scan signal line, a switching element that is turned on/off by the scan signal line, the pixel electrode connected to one end of the switching element, and a capacitive coupling interconnection capacitively-coupled to the pixel electrode, and further including a data signal line connected to the other end of the switching element on each of the rows, the display drive circuit comprising:

a scan signal line drive circuit that outputs, in a horizontal scanning period which is sequentially allocated to the each of the rows, a scan signal for turning on the switching element on one row;

a data signal line drive circuit that outputs a data signal of which polarity is reversed in sync with the horizontal scanning period for the each of the rows and of which polarity is opposite in an adjacent horizontal scanning period on one and the same row;

a capacitive coupling interconnection drive circuit that outputs, after the horizontal scanning period for the each of the rows, a potential shift signal of which potential is switched between two potential levels along a direction determined according to the polarity of the data signal in the horizontal scanning period concerned; and a control circuit that controls the signal line drive circuits and the capacitive coupling interconnection drive circuit, the control circuit inputting to the capacitive coupling interconnection drive circuit a control signal which is different between the adjacent rows, the control signal corresponding to a polarity signal of which polarity is reversed in sync with the horizontal scanning period for the each of the rows, so that the potential of the potential shift signal in an initial state which starts when the display panel starts operating upon its activation, is different between the adjacent rows, wherein the capacitive coupling interconnection drive circuit includes D-latch circuits and outputs the potential shift signal so that (i) in the initial state which starts when the display panel starts operating upon its activation, potentials of potential shift signals on all of the rows are fixed to one of the two potential levels and different between adjacent rows, and (ii) in a first vertical scanning period which comes after the initial state and from which output of a data signal corresponding to a video image to be displayed is started, a potential of the potential shift signal at a time of on-to-off switching of the switching element on the one row is different from a potential of a potential shift signal on an adjacent row, the capacitive coupling interconnection drive circuit outputs a first control signal if the polarity signal is of the first polarity when the scan signal on the one row is turned on in the first vertical scanning period, while the control circuit outputs a second control signal if the polarity signal is of the second polarity when the scan signal on the one row is turned on in the first vertical scanning period, and the control circuit inputs to the capacitive coupling interconnection drive circuit a reset signal as the first control signal if the polarity of the polarity signal when the scan signal on the one row is turned on in the first vertical scanning period is in low level, while the control circuit inputs to the capacitive coupling interconnection drive circuit a set signal as the second control signal if the polarity of the polarity signal when the scan signal on the one row is turned on in the first vertical scanning period is in high level.

8. A display drive circuit for carrying out display with a tone corresponding to a potential of a pixel electrode by driving a display panel including a plurality of rows each including a scan signal line, a switching element that is turned on/off by the scan signal line, the pixel electrode connected to one end of the switching element, and a capacitive coupling interconnection capacitively-coupled to the pixel electrode, and further including a data signal line connected to the other end of the switching element on each of the rows, the display drive circuit comprising:

a scan signal line drive circuit that outputs, in a horizontal scanning period which is sequentially allocated to the each of the rows, a scan signal for turning on the switching element on one row;

a data signal line drive circuit that outputs a data signal of which polarity is reversed in sync with the horizontal scanning period for the each of the rows and of which polarity is opposite in an adjacent horizontal scanning period on one and the same row;

a capacitive coupling interconnection drive circuit that outputs, after the horizontal scanning period for the each of the rows, a potential shift signal of which potential is switched between two potential levels along a direction determined according to the polarity of the data signal in the horizontal scanning period concerned; and a control circuit that controls the signal line drive circuits and the capacitive coupling interconnection drive circuit, the control circuit inputting to the capacitive coupling interconnection drive circuit a control signal which is different between the adjacent rows, the control signal corresponding to a polarity signal of which polarity is reversed in sync with the horizontal scanning period for the each of the rows, so that the potential of the potential shift signal in an initial state which starts when the display panel starts operating upon its activation, is different between the adjacent rows, wherein the capacitive coupling interconnection drive circuit outputs the potential shift signal so that: (i) in the initial state which starts when the display panel starts operating upon its activation, potentials of potential shift signals on all of the rows are fixed to one of the two potential levels and different between adjacent rows, and (ii) in a first vertical scanning period which comes after the initial state and from which output of a data signal corresponding to a video image to be displayed is started, a potential of the potential shift signal at a time of on-to-off switching of the switching element on the one row is different from a potential of a potential shift signal on an adjacent row, the capacitive coupling interconnection drive circuit includes:

a first input section that receives a scan signal on a row subsequent to the one row, a second input section that receives a polarity signal of which polarity is reversed in sync with the horizontal scanning period for the each of the rows, the polarity signal corresponding to the potential level of the potential shift signal, and an output section that outputs the potential shift signal on the one row, and the capacitive coupling interconnection drive circuit changes the potential of the potential shift signal in accordance with a polarity of the polarity signal inputted to the second input section when the scan signal on the row subsequent to the one row is inputted to the first input section.

9. A display driving method for carrying out display with a tone corresponding to a potential of a pixel electrode by driving a display panel including a plurality of rows each including a scan signal line, a switching element that is turned on/off by the scan signal line, the pixel electrode connected to one end of the switching element, and a capacitive coupling interconnection capacitively-coupled to the pixel electrode, and further including a data signal line connected to the other end of the switching element on each of the rows, the display driving method comprising:

a scan signal line driving process of outputting, in a horizontal scanning period which is sequentially allocated to the each of the rows, a scan signal for turning on the switching element on one row;

a data signal line driving process of outputting a data signal of which polarity is reversed in sync with the horizontal scanning period for the each of the rows and of which polarity is opposite in an adjacent horizontal scanning period on one and the same row; and a capacitive coupling interconnection driving process of outputting, after the horizontal scanning period for the each of the rows, a potential shift signal of which potential is switched between two potential levels along a direction determined according to the polarity of the data signal in the horizontal scanning period concerned, wherein the capacitive coupling interconnection drive circuit outputs the potential shift signal such that (i) upon activation of the display panel, potentials of potential shift signals on all of the rows are fixed to a same one of the two potential levels and (ii) in a first vertical scanning period following the activation of the display panel, from which output of a data signal corresponding to a video image to be displayed is started, a potential of the potential shift signal at a time of on-to-off switching of the switching element on the one row is different from a potential of a potential shift signal on an adjacent row.

* * * * *